US007593678B2

(12) United States Patent
Suenaga

(10) Patent No.: US 7,593,678 B2
(45) Date of Patent: Sep. 22, 2009

(54) FIXING APPARATUS AND IMAGE-FORMING APPARATUS HAVING THE SAME

(75) Inventor: Takenori Suenaga, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 462 days.

(21) Appl. No.: 11/634,685

(22) Filed: Dec. 6, 2006

(65) Prior Publication Data

US 2007/0212135 A1 Sep. 13, 2007

(30) Foreign Application Priority Data

Mar. 13, 2006 (JP) ..... 2006-067192
Oct. 10, 2006 (JP) ..... 2006-275990

(51) Int. Cl.
*G03G 15/20* (2006.01)

(52) U.S. Cl. ..... 399/323; 399/329

(58) Field of Classification Search ..... 399/45, 399/68, 323, 328, 329, 331; 219/216
See application file for complete search history.

(56) References Cited

U.S. PATENT DOCUMENTS 5,614,999 A * 3/1997 Kanesawa et al. ..... 399/329
6,785,505 B2 * 8/2004 Yasui et al. ..... 399/329
6,975,829 B2 * 12/2005 Aruga ..... 399/329
6,983,119 B2 * 1/2006 Nakayama ..... 399/341
7,133,716 B2 * 11/2006 Kraemer et al. ..... 600/547
7,187,900 B2 * 3/2007 Fuma et al. ..... 399/329
7,447,472 B2 * 11/2008 Sugiyama ..... 399/328
7,477,858 B2 * 1/2009 Fujii et al. ..... 399/67

FOREIGN PATENT DOCUMENTS

JP 08-262893 10/1996
JP 09258596 A * 10/1997
JP 10228198 A * 8/1998
JP 10228200 A * 8/1998
JP 11-002987 1/1999
JP 2004233837 A * 8/2004
JP 2005257968 A * 9/2005
JP 2005283926 A * 10/2005
JP 2006030744 A * 2/2006

* cited by examiner

*Primary Examiner*—Robert Beatty
(74) *Attorney, Agent, or Firm*—Cantor Colburn LLP

(57) ABSTRACT

The present invention proposes a fixing apparatus which can properly adjust the fixing ability and the curvature separation ability based on sheet quality, and an image forming apparatus having the same fixing apparatus. This fixing apparatus, which forms images through fixing the toner images on the sheet, includes an endless belt which is pressure-contacted against the fixing roller, a pressure applying member which makes the endless belt to come into pressure-contact with the fixing roller to form a pressure-contact region, and a separation member which is integral to the pressure applying section and is depressed into the fixing roller, wherein when the pressure applying member swings in a direction in which an area of contact between the endless belt and the fixing roller increases, the separation member swings in a direction in which a depressed depth of the endless belt into the fixing roller decreases, and vice versa.

9 Claims, 7 Drawing Sheets

FIXING APPARATUS AND IMAGE-FORMING APPARATUS HAVING THE SAME

This application is based on Japanese Patent Application No. 2006-67192 filed on Mar. 13, 2006, in Japanese Patent Office, and 2006-275990 filed on Oct. 10, 2006, in Japanese Patent Office, the entire content of which is hereby incorporated by reference.

TECHNICAL FIELD

The present invention relates to an image forming apparatus, suck as a printer, a copy machine and a facsimile, and in particular, to a fixing apparatus which fixes toner images yet to be fixed and formed on a sheet, and an image forming apparatus having the same fixing apparatus.

BACKGROUND

In an image forming apparatus employing an electro-photographic method, after an electrostatic latent image is formed on a photoconductor by laser light rays, the electrostatic latent image is developed to be a toner image using toner particles, then the toner image is directly transferred onto a sheet, or the toner image is transferred onto an intermediate transfer member, which is then transferred onto the sheet. Next, the toner image is fixed on the sheet by pressure and heating by a fixing apparatus. The fixing apparatus incorporates a fixing roller having a halogen lamp as a heat source, and a pressure applying roller to press against the fixing roller, wherein the sheet carrying the toner image is introduced through a pressure-contact region between the heated fixing roller and the pressure applying roller, and thereby the toner particles are melted and fixed onto the sheet.

The fixing roller, which fixes the toner image, incorporates an elastic layer and a releasing layer. In case of full-color image fixing, an amount of employed toner is very large, and in order to apply effective pressure onto the sheet carrying the toner image, it is necessary that the surface area of the pressure-contact region is enlarged, and that the time interval to sufficiently heat the toner is obtained. Since the adhering force is increased between the sheet and the fixing roller after the toner image is fixed, a separating claw is generally used to separate the sheet from the fixing roller.

However, there is a risk of the claw damaging the fixing roller. Further, since the amount of toner is very large, the amount of wax in the toner is also large, whereby wax is adhered to the separating claw. Scarring of the fixing roller or adhered wax results in the defected images or dirty images. Accordingly it is preferable that a separating claw should not be used to separate the image carrying sheet in the image forming apparatus.

As a sheet separating method using no claw, there is a curvature separating method. In the curvature separating method, while the fixing roller widely changes the conveyance direction of the sheet from the exit point of the separation section by its own curvature, the sheet keeps straightness due to its stiffness, whereby the sheet can be easily separated from the surface of the fixing roller.

However in such a fixing apparatus, since an elastic layer is provided on a periphery of the fixing roller, heat capacity of the fixing roller is so large that when the apparatus is electrically activated or turned to operation mode from its energy saving mode, the fixing apparatus consumes greater electrical power and requires a long start-up time to heat up the fixing roller to the temperature required to conduct the fixing operation. Further, during the standby condition until the next image formation starts, the heat is transmitted to the pressure applying roller through the pressure-contact region, therefore, in order to keep the fixing roller at the essential temperature for the fixing operation, the fixing roller needs to be continuously heated, which results in a problem of energy loss.

To overcome these problems, Japanese Laid-Open Patent Publication No. H8-262893 discloses a fixing apparatus in which the start-up time is shortened.

In this fixing apparatus, an endless belt, instead of the pressure applying roller, is used for reducing the heat capacity. That is, an elastic pressing member and a belt guide are arranged parallel to the fixing roller, and the endless belt is provided outside the elastic pressing member and the belt guide. The endless belt presses against the surface of the fixing roller by the elastic pressure applying member, and the endless belt is driven by the rotation of the fixing roller.

In this fixing apparatus, since the elastic pressing member presses the endless belt onto the fixing roller, the thickness of the elastic layer of the fixing roller is reduced, and thereby a fixing roller having a smaller diameter can be used. Further, the width of a pressure applying pad is increased in the rotation direction of the fixing roller so that the area of the pressure-contact region is increased, which improves the efficiency of the fixing apparatus. Yet further, the thickness of the elastic layer of the fixing roller is reduced so that the heat capacity of the fixing roller is reduced, which can shorten the start-up time. In addition, the thickness of the endless belt is reduced so that any heat escaping from the fixing roller through the pressure-contact region is also reduced, and thereby there is no need to turn on the heating lamp during the waiting time until the next image formation starts, which is very effective to save energy.

However, in this fixing apparatus, the problem described below exists. That is, in the above-described fixing apparatus, since the endless belt is in pressure-contact with the small diameter fixing roller by the elastic pressure applying member, the endless belt at the pressure-contact region is concaved while going over the curved surface of the fixing roller. Further, after the endless belt passes through the pressure-contact region, that is, when the endless belt reaches downstream of the pressure-contact region, the endless belt moves along the surface of the fixing roller.

Accordingly, at the exit of the pressure-contact region, force is generated to curve the sheet over the curvature of the fixing roller, which prevents the separation of the sheet from the fixing roller, or any toner separated from the fixing roller may again adhere onto the fixing roller, which may result in the sheet being wound around the fixing roller.

Accordingly, Japanese Laid-Open Patent Publication No. H11-2987 discloses a pressure applying pad shown in FIGS. 8 and 9. FIG. 8 shows a structure of relevant parts of the conventional fixing apparatus, while FIG. 9 shows an enlargement of a part of FIG. 8.

Fixing roller 51 is rotatably supported around the central axis, and endless belt 52 is provided under fixing roller 51. Within endless belt 52, pressure applying pad 53 and belt guide 54 are integrally supported parallel to the axis of fixing roller 51. Around pressure applying pad 53 and belt guide 54, endless belt 52 is arranged so that endless belt 52 can move under a non-tension condition in the direction of rotation. Endless belt 52 comes into pressure-contact with fixing roller 51 by pressure applying pad 53. As shown in FIG. 9, on pressure-contact region Z, fixing roller 51 and pressure applying pad 53 come into pressure-contact with pressure applying member 64, along length W in the rotational direction of fixing roller 51.

Fixing roller 51 is formed of coating layer 62, including base layer 62*a* and separating layer 62*b*, formed on the surface of cylindrical steel base 61. Elastic base layer 62*a* is made of silicon rubber, and separating layer 62*b* is dip-coated Viton rubber.

Halogen lamp 57 is provided as a heat source in the space of steel base 61 of fixing roller 51. Temperature sensor 58 detects any change of temperature of the surface of fixing roller 51, and a feedback system, which is not illustrated, functions to control halogen lamp 57, based on signals from temperature sensor 58, so that the surface temperature of fixing roller 51 is controlled within a predetermined temperature range.

Endless belt 52 is formed of thermosetting polyimide, at a thickness of less than 100 μm, and the periphery surface is covered with 30 μm of fluorocarbon resin as a separating layer. The inner length of endless belt 52 is set to be slightly longer than the length totally including pressure applying pad 53 and belt guide 54.

Pressure applying pad 53 includes elastic pressure applying member 64 made of silicon rubber, and separation member 65 which is on the downstream of and adjacent to the pressure-contact region of pressure applying member 64, both of which are arranged on supporting member 56. Supporting member 56 is supported on belt guide 54. The surface of pressure applying member 64 is covered with low friction film 66. Separation member 65 is structured of a metallic material in bar. Low friction film 66 enables endless belt 52 to move easily, and includes fiber glass sheet impregnated with fluorocarbon resin.

Now, the fixing procedure of the fixing apparatus will be explained. Sheet P, on which color toner image "t" has been transferred by a transfer apparatus which is not illustrated, is conveyed to pressure-contact region Z between fixing roller 51 and endless belt 53. Fixing roller 51 is rotated by an unillustrated drive motor in direction "a" in FIG. 8. Endless belt 52 is driven by fixing roller 51 to move around in direction "b". In pressure-contact region Z, endless belt 52 is curved in the same degree of curvature as the contact periphery of fixing roller 51. Sheet P, conveyed into pressure-contact region Z, is heated by fixing roller 51 which itself is heated by halogen lamp 57, and is pressed by pressure applying pad 53 through endless belt 52, whereby toner image "t" is fixed onto sheet P.

Sheet P, which passed through pressure-contact region Z, tends straighten itself due to its inherent elastic force, but sheet P might also adhere and be wound around fixing roller 51 at the exit of pressure-contact region Z due to the stickiness of the melted toner. Consequently, separation member 65 is provided to improve the curvature separation ability of the sheet.

That is, since fixing roller 51 is pressed by separation member 65 to have an elastic deformation, concave section of depth δ is generated, therefore, the curvature of a partial section of fixing roller 51 becomes large. Due to this, endless belt 52 is curved with large curvature along the surface of separation member 65 at the downstream of pressure-contact region Z, and endless belt 52 is driven in the direction separating from fixing roller 51. As a result, sheet P is also conveyed in the direction separating from fixing roller 51 at the exit of pressure-contact region Z, which further improves the effect of the curvature separation. By this structure, though a separating claw is not used, very thin sheets P can be separated from fixing roller P without trouble.

However, the fixing apparatus described in Japanese Laid-Open Patent Publication No. H11-2987 exhibits the shortcoming below. Sheet P is of varying thickness and quality. For example, in a case of a thick sheet, the elastic force of the sheet is so large that the sheet separates from fixing roller 51 easily, causing fixing of the toner image to deteriorate. It is because as the sheet thickness increases so does the heat capacity of the sheet, which takes a longer time to melt the toner particles. On the other hand, in the case of too thin a sheet, the heat capacity is so small that fixing can be conducted satisfactorily, but the elasticity of the thin sheet is so small that the separation from the fixing roller 51 becomes a major problem. In addition, in the fixing apparatus described in Japanese Laid-Open Patent Publication No. H11-2987, the position and the pressure at which pressure applying member 64 and separation member 65 come into pressure contact with fixing roller 51 is constant, and cannot vary in accordance with the characteristics of sheet P.

Additionally, endless belt 52 does not always come into pressure-contact with fixing roller 51, but endless belt 52 goes down to separate from fixing roller 51 at a clearance of 1-2 mm, while awaiting the fixing operation. Because if endless belt 52 is always in pressure-contact with fixing roller, fixing roller 51 and endless belt 52 tend to deform and deteriorate so that their operating life shortens. For this reason, they are separated from each other while awaiting the fixing operation, and longer function can be attained from them. When image formation starts, pressure applying member 64 goes up, and brings endless belt 52 into pressure contact with fixing roller 51. It is possible to adjust the contact pressure by changing the raising amount of pressure applying member 64, but in this method, the applying pressure of pressure applying pad 53 and separation member 65 change simultaneously in the same direction, which can not allow adjustment of the applied pressure in accordance with the sheet characteristics.

SUMMARY

In view of forgoing, one embodiment according to one aspect of the present invention is a fixing apparatus for fixing a toner image on a sheet of paper to form an image, comprising:

- a fixing roller which includes a heat source therein;
- an endless belt which is brought into contact with the fixing roller by pressure;
- a pressure applying member for bringing the endless belt into contact with the fixing roller to form a pressure contact region between the endless belt and the fixing roller;
- a separation member, integrated with the pressure applying member, for separating a sheet of paper by curvature separation by pressing the endless belt against the fixing roller at a downstream of the pressure applying member in the running direction of the endless belt to cause an elastic deformation so as to depress the endless belt into the fixing roller; and
- a driving device for swinging the pressure applying member and the separation member together such that an area of the pressure contact region is varied by the swing of the pressure applying member, and a depth of the depression of the endless belt into the fixing roller is varied by the swing of the separation member, wherein the driving device swings the separation member in a direction where the depth of the depression of the endless belt into the fixing roller is decreased when swinging the pressure applying member in a direction where the area of the pressure contact region between the endless belt and the fixing roller is increased, and swings the separation member in a direction where the depth of the depression of the endless belt into the fixing member is increased when swinging the pressure applying member in a direction where the area of the pressure contact region between the endless belt and the fixing roller is decreased.

According to another aspect of the present invention, another embodiment is an image forming apparatus for forming an image on a sheet of paper, comprising:

an image forming section for forming a toner image on the sheet of paper; and an fixing apparatus for fixing the toner image on the sheet of paper, the fixing apparatus, including:

a fixing roller which includes a heat source therein;

an endless belt which is brought into contact with the fixing roller by pressure;

a pressure applying member for bringing the endless belt into contact with the fixing roller to form a pressure contact region between the endless belt and the fixing roller;

a separation member, integrated with the pressure applying member, for separating a sheet of paper by curvature separation by pressing the endless belt against the fixing roller at a downstream of the pressure applying member in the running direction of the endless belt to cause an elastic deformation so as to depress the endless belt into the fixing roller; and a driving device for swinging the pressure applying member and the separation member together such that an area of the pressure contact region is varied by the swing of the pressure applying member, and a depth of the depression of the endless belt into the fixing roller is varied by the swing of the separation member, wherein the driving device swings the separation member in a direction where the depth of the depression of the endless belt into the fixing roller is decreased when swinging the pressure applying member in a direction where the area of the pressure contact region between the endless belt and the fixing roller is increased, and swings the separation member in a direction where the depth of the depression of the endless belt into the fixing member is increased when swinging the pressure applying member in a direction where the area of the pressure contact region between the endless belt and the fixing roller is decreased.

DETAILED DESCRIPTION OF THE PREFERRED EMBODIMENT

Figure 1:
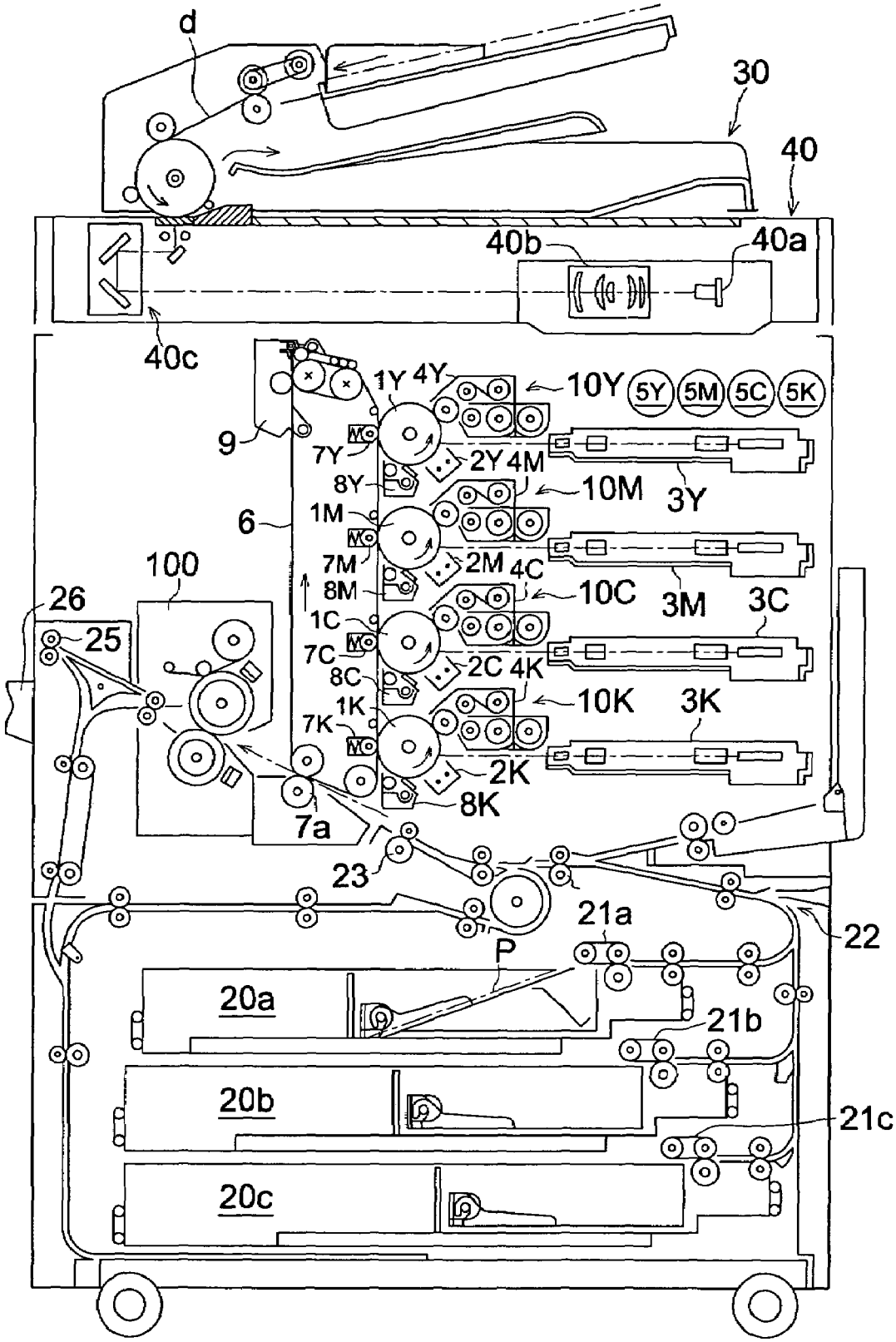
FIG. 1 shows a structure of the image forming apparatus relating to an embodiment of the present invention.

The embodiment of the present invention will now be detailed referring to the drawings. While the preferred embodiments of the present invention have been described using specific terms, such description is for illustrative purpose only, and it is to be understood that changes and variations may be made without departing from the spirit or scope of the appended claims.

In the conventional fixing apparatus, image fixing can not be conducted well on thick sheets, but the elasticity of the sheet is so high that the thick sheet separates from the fixing roller with ease. On the other hand, image fixing can be conducted well on thin sheets, but the elasticity of the sheet is so low that the sheet can not be separated from the fixing roller with ease.

In the present invention, in order to fix the toner well on a thick sheet, the pressure applying member is swung in the rotating direction of the fixing roller, so as to increase the width of the pressure-contact region between the fixing roller and the endless belt, while in order to reduce the separating force, the separation member is swung so as to shallowly press the separation member into the surface of the fixing roller, because separation is easy in the case of thicker sheets.

On the other hand, in the case of a thin sheet, the pressure applying member is swung so as to reduce excessive fixing, through decreasing the area of the pressure-contact region formed in the rotational direction of the fixing roller, while in order to increase the separating force, the separation member is swung so as to deeply press the separation member into the surface of the fixing roller, and thereby the curvature of the fixing roller is partially increased so that the separating force also increases.

By the above-described methods in which the positions of the pressure applying member and the separation member are changed, it is possible to fix toner on thick sheets as easily as on thin sheets, and to separate the sheet from the fixing roller.

Since the embodiment of the present invention is structured in that the pressure applying member and the separation member are integrally supported on the same supporting member, wherein a driving device simultaneously swings the pressure applying member and the separation member, by rotating a rotation shaft integrated to the supporting member, and wherein the operation is conducted with ease.

Further, since the image forming apparatus incorporates a display/operation section, an operator can control the driving device through the display/operation section, which has a beneficial effect, because the operation can be conducted from the outside with ease.

FIG. 1 shows the structure of the image forming apparatus as an embodiment of the present invention. The image forming apparatus shown in the figure is referred to as a tandem type color image forming apparatus, which includes automatic document feeding apparatus 30, image reading apparatus 40, image writing apparatuses 3Y, 3M, 3C, and 3K, photoconductors 1Y, 1M, 1C, and 1K, electrostatic charging apparatuses 2Y, 2M, 2C, and 2K, developing devices 4Y, 4M, 4C, and 4K, fixing apparatus 100, image carrier 6 being an intermediate transfer belt, sheet supply cassettes 20*a*, 20*b*, and 20*c*, and conveyance system 22.

Toner replenishing sections 5Y, 5M, 5C and 5K supply new toner to developing devices 4Y, 4M, 4C, and 4K.

Automatic document feeding apparatus 30 conveys original document "d", carrying an image on only one side or on both sides, to the image reading section. Image reading apparatus 40 reads out plural original documents "d" which are conveyed from an original document housing plate, in such a way that the images of the original document are reflected by three movable mirrors 40*c*, after which the images are formed on image pickup element 40*a* comprised of a CCD, by condenser lens 40*b*, and the images are read.

Image forming section 10Y, which forms yellow toner images, incorporates charging device 2Y, image writing apparatus 3Y, developing device 4Y and cleaning apparatus 8Y, all of which are arranged around photoconductor 1Y. Image forming section 10M, which forms magenta toner images, incorporates photoconductor 1M, charging device 2M, image writing apparatus 3M, developing device 4M and cleaning apparatus 8M. Image forming section 10C, which forms cyan toner images, incorporates photoconductor 1C, charging device 2C, image writing apparatus 3C, developing device 4C and cleaning apparatus 8C. Image forming section 10K, which forms black toner images, incorporates photoconductor 1K, charging device 2K, image writing apparatus 3K, developing device 4K and cleaning apparatus 8K. Charging device 2Y and image writing apparatus 3Y, charging device 2M and image writing apparatus 3M, charging device 2C and image writing apparatus 3C, and charging device 2K and image writing apparatus 3K form latent images of each color, respectively.

Image carrier 6 is an endless intermediate transfer belt. Image carrier 6 is extended by plural rollers and is rotatably supported. Cleaning apparatus 9 is provided on image carrier 6, which includes a cleaning roller and a cleaning blade.

Signals of information of the images formed on image pickup element 40*a* are sent to an image processing section. After image processing section performs an analog process, A/D conversion, shading compensation, and image compression process on the above signals, the image processing section sends the processed signals of each color to image writing apparatuses 3Y, 3M, 3C and 3K, respectively.

In image writing apparatuses 3Y, 3M, 3C and 3K, a semiconductor laser is used as a light source. Light beams, emitted from the semiconductor laser, form a scanning light beam via an optical element such as a polygonal mirror, and the scanning light beam scans photoconductors 1Y, 1M, 1C and 1K to form electrostatic latent images of each color.

Each color toner image formed by image forming sections 10Y, 10M, 10C and 10K is transferred to be superposed on rotating image carrier 6 by primary transfer apparatuses 7Y, 7M, 7C and 7K, whereby full color toner image is formed. Variously sized sheets P, which are accommodated in sheet supply cassettes 20*a*, 20*b*, and 20*c*, are conveyed by sheet supply sections 21*a*, 21*b* and 21*c* through conveyance system 22, after which feeding timing of sheet P is controlled by paired registration rollers 23. Then a sheet P is transferred to secondary transfer apparatus 7*a*, in which the full color toner images are transferred on sheet P. Sheet P, carrying the transferred full color toner image, is fixed by fixing apparatus 100 of the present embodiment, and is nipped by paired ejection rollers 25 to be conveyed to and set on sheet receiving tray 26.

In addition, image carrier 6, from which full color toner images have been transferred onto sheet P by secondary transfer apparatus 7*a*, and sheet P has been separated, is cleaned by cleaning apparatus 9.

Figure 2:
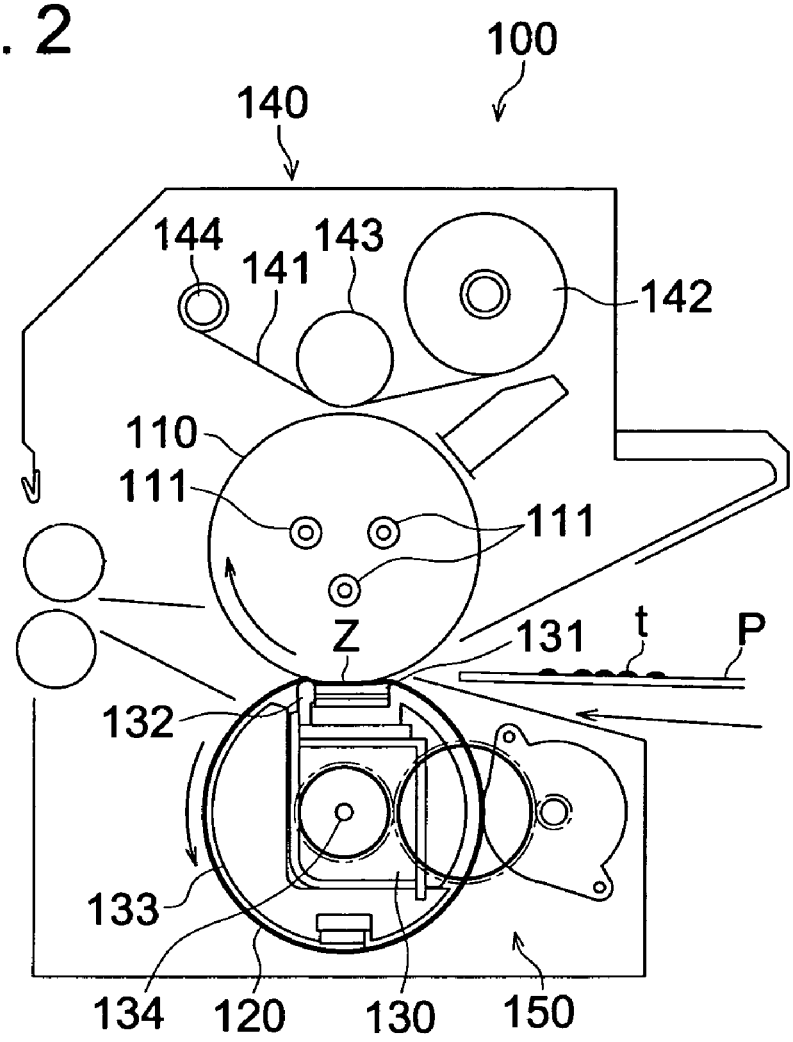
FIG. 2 shows a structure of the fixing apparatus relating to an embodiment of the present invention.
Figure 3:
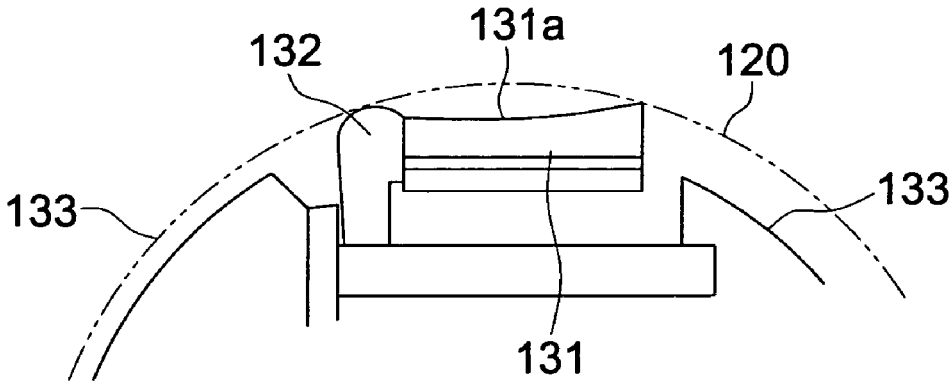
FIG. 3 is an enlargement of a relevant part of drawing of FIG. 2.
Figure 8:
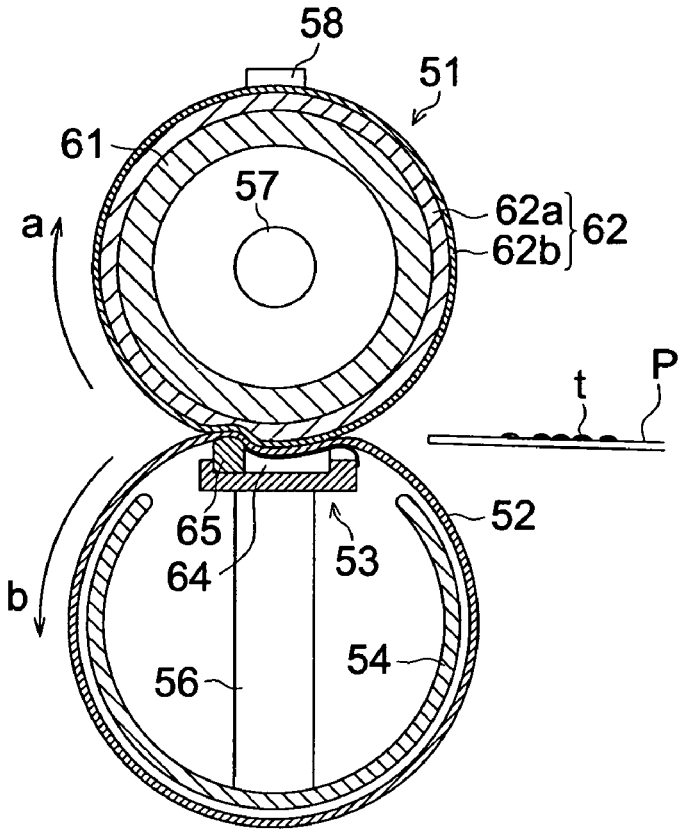
FIG. 8 CONVENTIONAL ART
FIG. 8 shows a relevant part structure of the conventional fixing apparatus.
Figure 9:
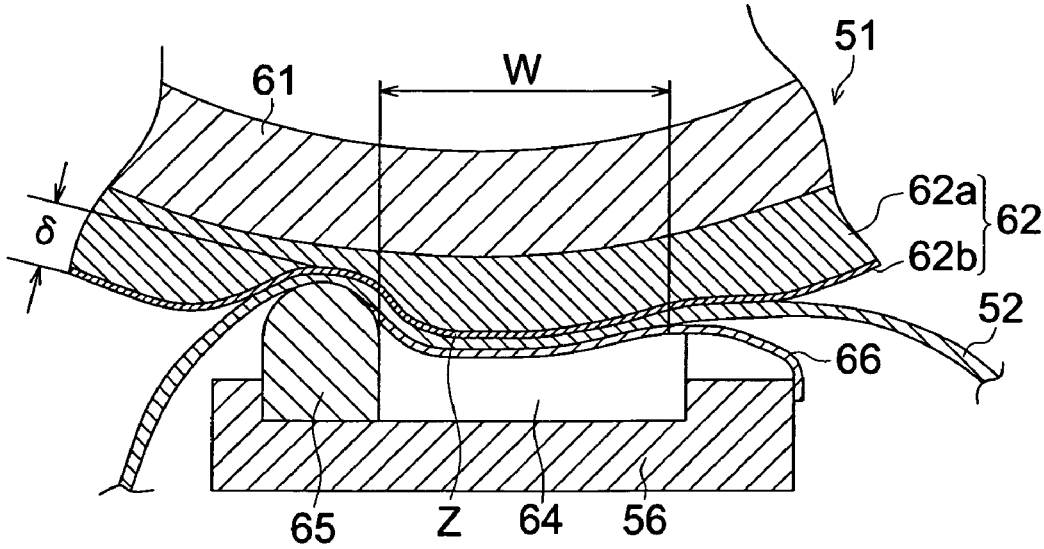
FIG. 9 CONVENTIONAL ART
FIG. 9 is an enlarged drawing of a part of FIG. 8.

FIG. 2 shows the structure of fixing apparatus 100 of the present invention, and FIG. 3 is an enlargement of the relevant part of FIG. 2. As shown by these figures, fixing apparatus 100 includes fixing roller 110, under which endless belt 120 is provided. Fixing roller 110 has the same structure as the conventional one detailed in FIG. 8. That is, fixing roller 110 has heat source 111 of a halogen lamp and the like within the body, while an elastic layer and separation layer are formed on the surface. Endless belt 120 also has nearly the same structure as a conventional one, in which supporting member 130 is provided parallel to the rotation shaft of fixing roller 110. On the top of supporting member 130, pressure applying member 131, arranged parallel to the rotation shaft of fixing roller 110, and separation member 132, adjacent to pressure applying member 131, are integrally assembled. Further, supporting member 130 is fixed to rotation shaft 134. On either side and on a lower section of supporting member 130, belt guide 133 is provided. Endless belt 120 is extended around the outside of pressure applying member 131, separation member 132 and belt guide 133. Clearance is secured between endless belt 120 and belt guide 133 so that no tension is generated in the rotational direction.

Above fixing roller 110, cleaning apparatus 140 is provided, which includes supply shaft 142 on which cleaning web 141 is wounded, depressing roller 143 which presses cleaning roller 141 onto fixing roller 110, and take-up shaft 144 which takes up cleaning web 141.

Cleaning web 141 supplied from supply shaft 142 is pressed onto fixing roller 110 by depressing roller 143, and cleans the surface of fixing roller 110. Used cleaning web 141 is taken up by take-up shaft 144.

Pressure applying member 131 presses endless belt 120 against fixing roller 110. The length of pressure applying member 131 is slightly longer than that of endless belt 120 whose axial length is the same as that of fixing roller 110. In order to press endless belt 120 against fixing roller 110 at an even pressure, a straight and heat-resistant plastic member is used for pressure applying member 131. Further, surface 131*a* of pressure applying member 131 has the same curvature as that of the periphery surface of fixing roller 110, whereby the rotational directional length of pressure-contact region Z, in which pressure applying member 131 is in contact with fixing roller 110, is lengthened.

Separation member 132 is formed by a grinding process of metal, such as aluminum or steel. The upper surface of separation member 132 presses endless belt 120 against fixing roller 110, and forces the surface of fixing roller 110 to become concave. In order to make endless belt 120, nipped between fixing roller 110 and separation roller 132, to be driven by the rotation of fixing roller 110, the surface of separation member 132 is smoothened.

Endless belt 120 is shown by a virtual line in FIG. 3. When endless belt 120 is under no load, it comes into contact with the top of pressure applying member 131 and the top of separation member 132, but endless belt 120 does not come into contact with belt guide 133.

Driving device 150 swings both pressure applying member 131 and separation member 132 at the same time. Driving device 150 will be detailed now.

Figure 4:
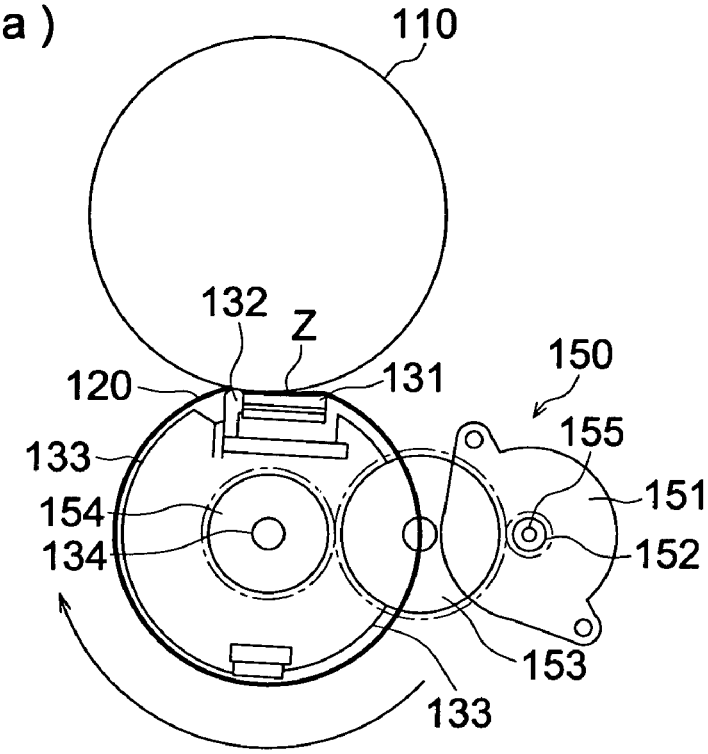
FIG. 4(*a*) shows a condition wherein the supporting member is slightly rotated clockwise, while FIG. 4(*b*) shows a condition wherein a supporting member is slightly rotated counterclockwise.
Figure 4:
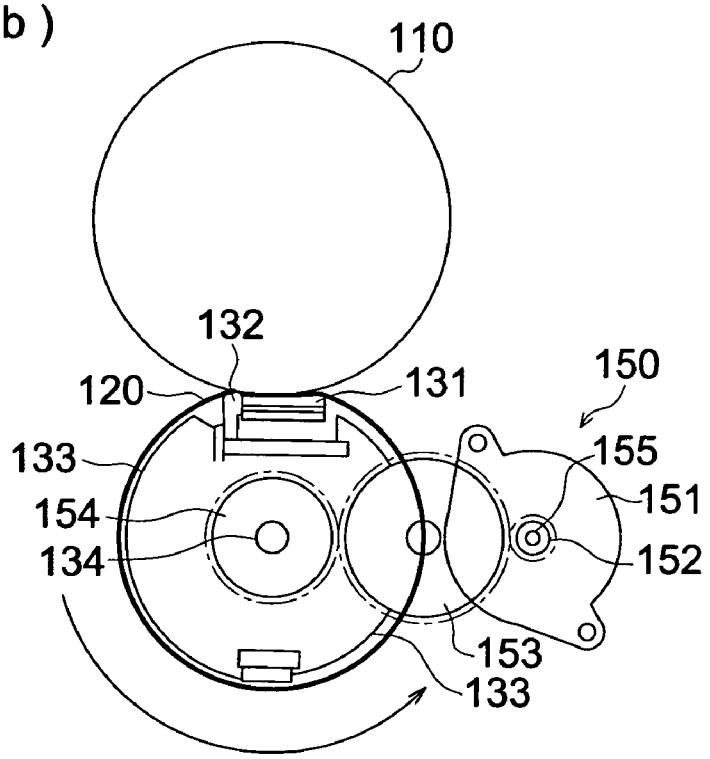

FIGS. 4(*a*) and 4(*b*) detail driving device 150 of fixing apparatus 100 relating to the present invention. Driving device 150 is structured of motor 151, small gear 152 mounted on the rotation shaft 155 of motor 151, intermediate gear 153 which engages small gear 152 with gear 154 mounted on rotation shaft 134 of supporting member 130. A speed reduction gear train is formed of small gear 152, intermediate gear 153 and gear 154. The rotation angle of small gear 152 mounted on the rotation shaft 155 of motor 151 is transmitted to rotation shaft 134 of supporting member 130 through the speed reduction gear train.

Figure 5:
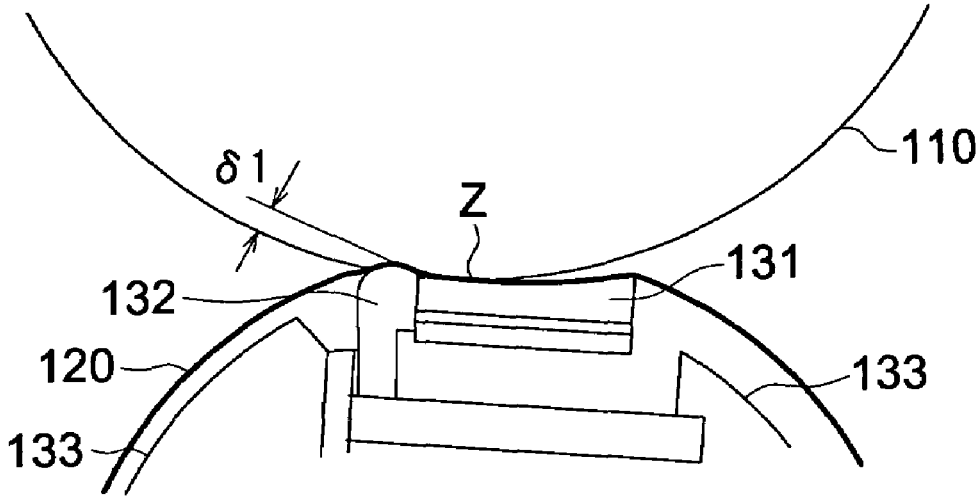
FIG. 5(*a*) is an enlarged drawing of a part of FIG. 4(*a*), which includes the pressure-contact region between the fixing roller and the endless belt, and their peripheral parts, while FIG. 5(*b*) is an enlarged drawing of a part of FIG. 4(*b*), which includes the pressure-contact region between the fixing roller and the endless belt, and their peripheral parts.
Figure 5:
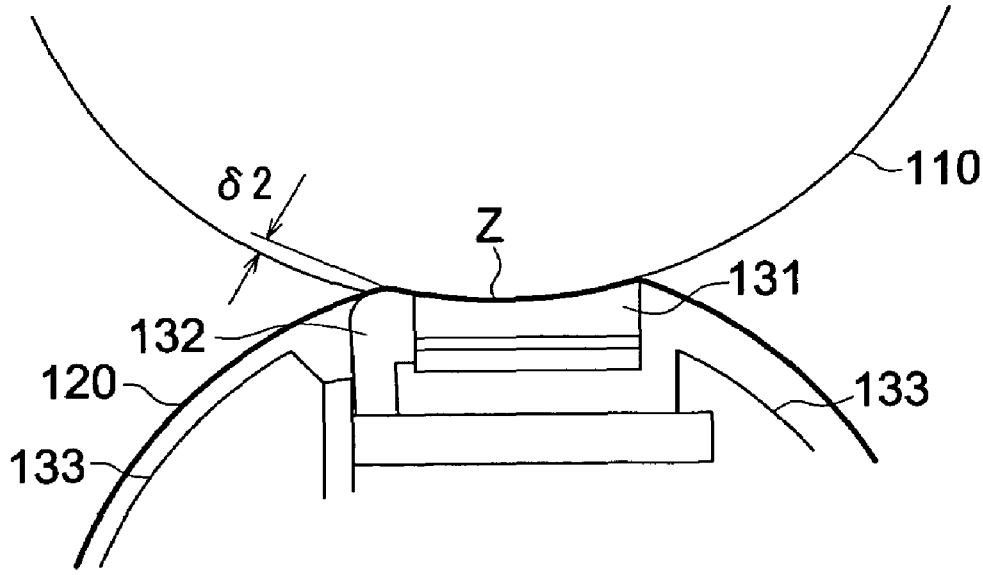

FIG. 4(*a*) shows a condition in which supporting member 130 has been slightly rotated clockwise. This condition means the setting suitable for thin sheets P. FIG. 5(*a*) is an enlargement showing pressure-contact region Z between fixing roller 110 and endless belt 120, and an enlarged periphery in this condition.

Only the section which is adjacent to separation member 132 of pressure applying member 131 presses endless belt 120 into fixing roller 110, while the top side sections of pressure applying member 131 do not. Accordingly, a rotation directional length of pressure-contact region Z is short, but depth δ1 is large, which shows the depth in which separating member 132 is pressed into the fixing roller 110. In this condition, since the area of pressure-contact region Z is very small so that the fixing time becomes short, but depth δ1 pressed into fixing roller 110 is relatively large so that the curvature of the surface of fixing roller 110 partially increases because of the pressed section. As a result, sheet P is easily curvature separated from fixing roller 110. That is, this condition is suitable for thin sheets which are easy to fix and difficult to separate from fixing roller 110.

FIG. 4(*b*) shows a condition in which supporting member 130 has been slightly rotated counterclockwise. This condition is the setting suitable for thick sheets P. FIG. 5(*b*) is an enlargement showing pressure-contact region Z between fixing roller 110 and endless belt 120, and its peripheral part in this condition.

Since almost the total length of pressure applying member 131 presses endless belt 120 against fixing roller 110, the rotation directional length of pressure-contact region Z is the longest, but depth δ2 is relatively smaller, and FIG. 5(B) shows depth δ2 in which separating member 132 is pressed into fixing roller 110. In this condition, since the area of pressure-contact region Z is relatively large so that the fixing time becomes long, but depth δ2 pressed into fixing roller 110 is relatively short so that the curvature of the surface of fixing roller 110 is partially decreased compared to the condition of thin sheet separation. As a result, the curvature separation ability of sheet P becomes lower by the decreased curvature. That is, this condition is suitable for image fixing on thick sheets which are difficult to fix and easy to curvature separate from fixing roller 110.

Figure 6:
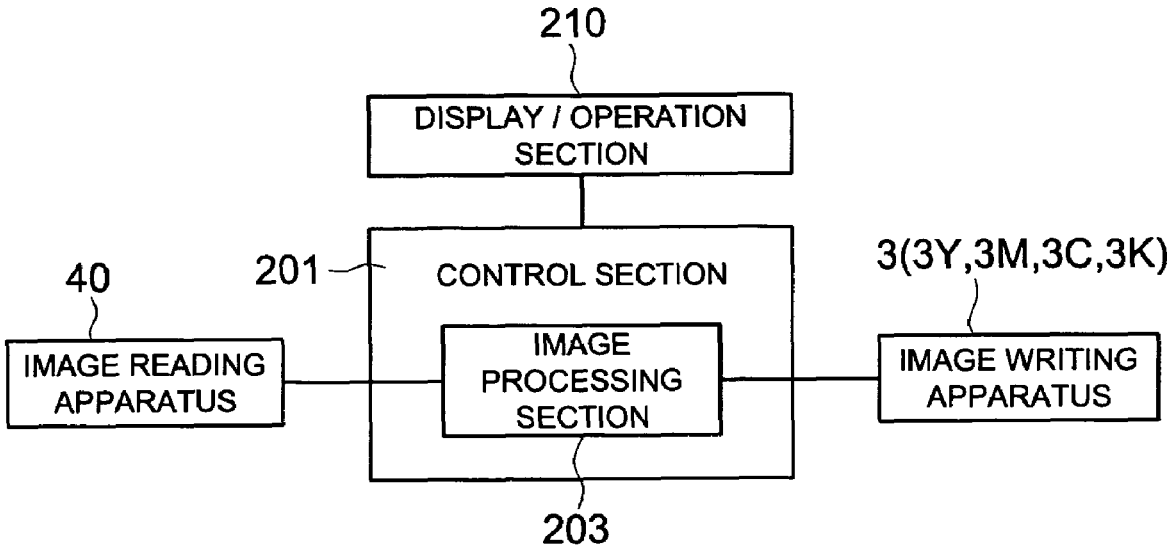
FIG. 6 is a block chart showing the general structure of the control apparatus provided in the image forming apparatus relating to an embodiment of the present invention.

FIG. 6 is a block chart showing a general structure of the control apparatus provided in the image forming apparatus relating to the present embodiment. Control section 201 is structured of a CPU, ROM and RAM. Image information read out by image reading apparatus 40 is processed by analog processing, A/D conversion, shading compensation, and image compression processing, in image processing section 203 within control section 201. Control section 201 sends signals for each color to respective image writing apparatuses 3 (3Y, 3M, 3C and 3K). In this image forming apparatus, display/operation section 210 is provided, through which an operator inputs various information, such as the size of sheet P, the number of desired copies, and the magnification, to start the copy.

Figure 7:
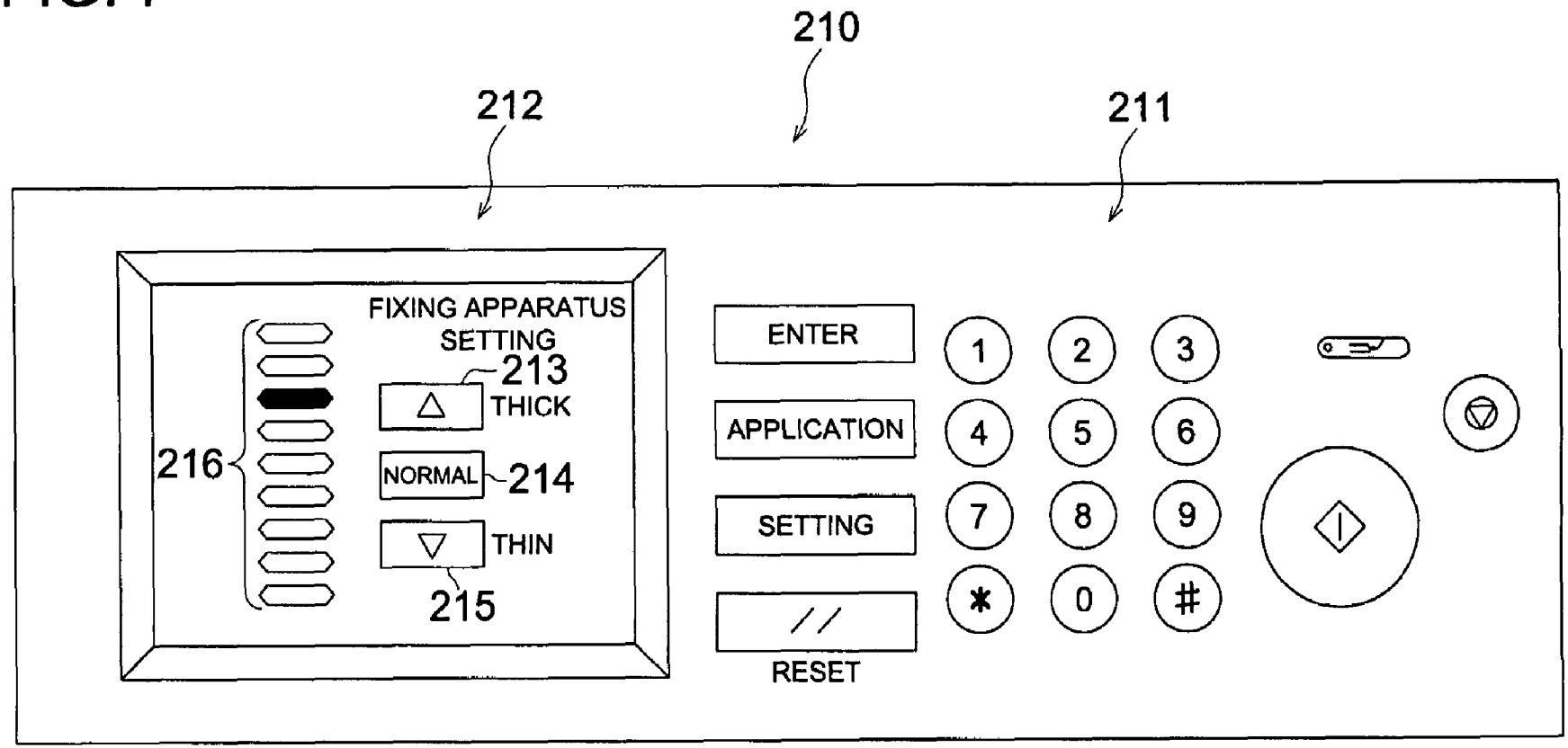
FIG. 7 shows an example of a display/operation section.

FIG. 7 shows an example of display/operation section 210. Display/operation section 210 is structured of input section 211 which includes numeric buttons 0-9, and selection buttons to select specific functions, such as "enter", "application" and "setting", and also of display section 212, being a liquid crystal panel. Display section 212 is also structured of a touch panel through which the operator can input various information.

In this embodiment, when the operator depresses the "setting" button on input section 211, plural setting screens are displayed, among which the operator may select "fixing apparatus setting", then the "fixing apparatus setting" screen is displayed. In this screen, there are three touch buttons, representing "thick" 213, "normal" 214 and "thin" 215. When the operator touches one of them, driving device 150 shown in FIG. 4 is activated. Specifically when the operator touches "normal" 214, motor 151 swings pressure applying member 131 and separation member 132 to a position which is intermediate between the positions shown in FIG. 4(*a*) and FIG. 4(*b*), (this position represents a home position). Simultaneously, a central hexagonal display 216 among nine hexagonal displays 216, located on the left of three touch buttons, changes its color. Next, when the operator once touches "thick" 213, motor 151 rotates for a predetermined angle and stops. A display which is one step upper than the central hexagonal display 216 in display section 212 changes its color. Each touch of buttons 213 or 215 makes motor 151 to rotate for a predetermined angle and to stop, which changes the position of display for one step up and down and changes its color in display section 212. When the operator touches "thin" 215, motor 151 rotates to another direction by the predetermined angle, and stops, and a display which is one step down and changes its color. Due to these input operations, the operator understands which sheet thickness is selected, therefore, the operator can swing pressure applying member 131 and separation member 132 to the desired position.

By the above-described operation, the apparatus can set plural positions of pressure applying member 131 and separation member 132.

In the above-described embodiment, the positions of pressure applying member 131 and separation member 132 are changed based on the thickness of the sheet. However, it is not limited to the thickness of the sheet, but the sheet quality can also be the reason to change the positions. To change the positions with respect to the sheet quality, which can be displayed in addition to sheet thickness displays in FIG. 7.

What is claimed is:

1. A fixing apparatus for fixing a toner image on a sheet of paper to form an image, comprising:

a fixing roller which includes a heat source therein;

an endless belt which is brought into contact with the fixing roller by pressure;

a pressure applying member for bringing the endless belt into contact with the fixing roller to form a pressure-contact region between the endless belt and the fixing roller;

a separation member, integrated with the pressure applying member, for separating a sheet of paper by curvature separation by pressing the endless belt against the fixing roller downstream of the pressure applying member in the running direction of the endless belt to cause an elastic deformation so as to depress the endless belt into the fixing roller; and a driving device for swinging the pressure applying member and the separation member together such that an area of the pressure contact region is varied by the swing of the pressure applying member, and a depth of the depression of the endless belt into the fixing roller is varied by the swing of the separation member, wherein the driving device swings the separation member in a direction where the depth of the depression of the endless belt into the fixing roller is decreased when swinging the pressure applying member in a direction where the area of the pressure contact region between the endless belt and the fixing roller is increased, and swings the separation member in a direction where the depth of the depression of the endless belt into the fixing member is increased when swinging the pressure applying member in a direction where the area of the pressure contact region between the endless belt and the fixing roller is decreased.

2. The fixing apparatus of claim 1, wherein the pressure applying member and the separation member are integrated being mounted on a common supporting member.

3. The fixing apparatus of claim 1, comprising:

a rotation shaft which is arranged on the supporting member, wherein the driving device rotates the rotation shaft to swing the pressure applying member and the separation member through the supporting member.

4. The fixing apparatus of claim 1, wherein the driving device has a plurality of stop positions when driving the pressure applying member and the separation member.

5. An image forming apparatus for forming an image on a sheet of paper, comprising:

an image forming section for forming a toner image on the sheet of paper; and an fixing apparatus for fixing the toner image on the sheet of paper, the fixing apparatus, including:

a fixing roller which includes a heat source therein;

an endless belt which is brought into contact with the fixing roller by pressure;

a pressure applying member for bringing the endless belt into contact with the fixing roller to form a pressure contact region between the endless belt and the fixing roller;

a separation member, integrated with the pressure applying member, for separating a sheet of paper by curvature separation by pressing the endless belt against the fixing roller downstream of the pressure applying member in the running direction of the endless belt to cause an elastic deformation so as to depress the endless belt into the fixing roller; and a driving device for swinging the pressure applying member and the separation member together such that an area of the pressure contact region is varied by the swing of the pressure applying member, and a depth of the depression of the endless belt into the fixing roller is varied by the swing of the separation member, wherein the driving device swings the separation member in a direction where the depth of the depression of the endless belt into the fixing roller is decreased when swinging the pressure applying member in a direction where the area of the pressure contact region between the endless belt and the fixing roller is increased, and swings the separation member in a direction where the depth of the depression of the endless belt into the fixing member is increased when swinging the pressure applying member in a direction where the area of the pressure contact region between the endless belt and the fixing roller is decreased.

6. The image forming apparatus of claim 5, wherein the pressure applying member and the separation member are integrated being mounted on a common supporting member.

7. The image forming apparatus of claim 5, wherein the fixing apparatus comprises a rotation shaft which is arranged on the supporting member, and the driving device rotates the rotation shaft to swing the pressure applying member and the separation member through the supporting member.

8. The image forming apparatus of claim 5, wherein the driving device has a plurality of stop positions when driving the pressure applying member and the separation member.

9. The image forming apparatus of claim 5, comprising:

a display/operation section with which the driving device is operated.

* * * * *